US006511012B2

(12) United States Patent
Hermanns et al.

(10) Patent No.: US 6,511,012 B2
(45) Date of Patent: Jan. 28, 2003

(54) APPARATUS FOR CONTROLLING THE TENSION OF A TRAVELING YARN IN AN AUTOMATIC WINDING DEVICE

(75) Inventors: Ferdinand-Josef Hermanns, Erkelenz (DE); Franz-Josef Flamm, Stollberg (DE); Christian Sturm, Krefeld (DE)

(73) Assignee: W. Schlafhorst AG & Co. (DE)

( * ) Notice: Subject to any disclaimer, the term of this patent is extended or adjusted under 35 U.S.C. 154(b) by 104 days.

(21) Appl. No.: 09/796,244

(22) Filed: Feb. 28, 2001

(65) Prior Publication Data

US 2001/0017331 A1 Aug. 30, 2001

(30) Foreign Application Priority Data

Feb. 29, 2000 (DE) ..... 100 09 611

(51) Int. Cl.[7] ..... B65H 23/24; B65H 23/16; B65H 59/12; H02K 33/00

(52) U.S. Cl. ..... 242/419.3; 242/147 M; 242/154; 242/419.7; 310/17; 310/19; 310/21; 318/127

(58) Field of Search ..... 242/147 M, 154, 242/419.3, 419.7, 481.2; 310/15, 17, 19, 20, 21; 318/123, 127

(56) References Cited

U.S. PATENT DOCUMENTS

| | | | | |
|---|---|---|---|---|
| 3,231,216 A | * | 1/1966 | Lemarchand | 242/154 |
| 3,351,296 A | * | 11/1967 | Frei | 242/147 M |
| 3,478,983 A | * | 11/1969 | Eppendahl et al. | 242/154 |
| 3,578,256 A | | 5/1971 | Vermeulen | |
| 4,523,440 A | * | 6/1985 | Voisin et al. | 156/51 |
| 5,499,772 A | * | 3/1996 | Maeda et al. | 242/154 |
| 5,738,295 A | | 4/1998 | Flamm et al. | |
| 6,135,377 A | * | 10/2000 | Covelli et al. | 242/154 |
| 6,224,009 B1 | * | 5/2001 | Zenoni | 242/147 M |
| 6,311,919 B1 | * | 11/2001 | Hermanns et al. | 242/481.2 |

FOREIGN PATENT DOCUMENTS

| | | |
|---|---|---|
| CH | 292372 | 8/1953 |
| DE | AS 12 36 383 | 3/1967 |
| DE | 30 25 765 C1 | 10/1981 |
| DE | 37 34 471 A1 | 4/1988 |
| DE | 38 38 162 A1 | 8/1989 |
| DE | 43 35 089 A1 | 4/1994 |
| DE | 195 44 202 A1 | 5/1997 |
| DE | 198 58 548 A1 | 6/2000 |
| FR | 1 334 485 | 7/1963 |
| GB | 713 450 | 8/1954 |
| GB | 2 125 072 A | 2/1984 |
| NL | 7 112 380 A | 3/1973 |

OTHER PUBLICATIONS

German Search Report.
European Search Report –EP 01100867.

* cited by examiner

*Primary Examiner*—Michael R. Mansen
(74) *Attorney, Agent, or Firm*—Kennedy Covington Lobdell & Hickman, LLP

(57) ABSTRACT

An apparatus for controlling the tension of a traveling yarn includes a rake tensioner having stationary and displaceable yarn tensioning elements in engagement with the traveling yarn, and an electrical coil to which electrical current is supplied by a regulating device. The displaceable yam tensioning elements and the electrical coil are disposed on a common pivot lever. The electrical coil is pivotable in an air gap through which magnetic field lines pass. The tension of the traveling yarn is controlled as a function of the current supplied to the electrical coil. The present invention, thusly, improves the control of the tension of the traveling yarn in spinning or bobbin winding machines.

6 Claims, 4 Drawing Sheets

APPARATUS FOR CONTROLLING THE TENSION OF A TRAVELING YARN IN AN AUTOMATIC WINDING DEVICE

CROSS-REFERENCES TO RELATED APPLICATIONS

This application claims the benefit of German patent application DE P 10009611.5 filed Feb. 29, 2000, herein incorporated by reference.

FIELD OF THE INVENTION

The present invention relates to an apparatus for controlling the tension of a traveling yam in an automatic winding device, particularly such devices having stationary and displaceable yam tensioning elements in engagement with the traveling yarn for controlling the tension of the traveling yarn in proportion to an electrical coil current generated by an electrical coil via electrical current supplied by a regulating device.

BACKGROUND OF THE INVENTION

German Patent Disclosure DE 37 34 471, discloses a rake tensioner device used to control the tension of yam traveling between a feed bobbin and a takeup bobbin of an automatic bobbin winder such that the increase in brake force, the tension imposed on the yarn by the rake tensioner, is reduced once the rotational speed of the takeup bobbin has reached a predetermined threshold value. The adjustable yarn tensioning elements of the rake tensioner are adjusted by an electric motor. In this kind of drive mechanism, the forward or reverse motion of the adjustable yarn tensioning elements is generated via gearing which converts the rotary motion of the motor into a linear motion.

German Patent Disclosure DE 198 58 548, which had not been published by the priority date of the present application, discloses a traversing device for delivering a yarn to a rotationally driven cross-wound bobbin, also known as a cheese, with a traversing yarn guide that is pivotable about a pivot shaft disposed perpendicular to the axis of the cheese. The end of the traversing yarn guide that guides the yam is moved back and forth by an electrical coil disposed in a magnetic field, the coil generating and controlling the motion of the traversing yarn guide for laying the yarn on a cheese.

An apparatus of the above identified type for controlling the tension of a traveling yarn is generally know, for example in German Patent Disclosure DE 43 35 089. In that construction, the yarn tension is controlled by an apparatus which can incrementally increase or decrease the yarn tension to a desired value, for instance in order to compensate for an increased unwinding tension. The apparatus for controlling the yarn tension is part of an automatic winding device. To avoid the expense that would be required if such an apparatus were used in every individual winding unit of a bobbin winder, an output signal for controlling the yarn tension is obtained from a specific spindle and other spindles of the bobbin winder are controlled on the basis of this output signal. A tensioning device, for example a rake tensioner, having a pair of cooperating comblike parts and a solenoid acts, via a rod linkage system and an eccentric element, to adjust the degree to which the combs mesh with the traveling yarn, thus adjusting the amount of the contact angle of the yarn relative to the teeth of the combs. This construction results in relatively high inertia within the moving parts and a looseness, or play, in the gears or other transmission elements. Because of the imposed inertia, such yarn tensioners tend to increase the peak values of the yarn tension and to impair the quality of the tension control.

German Patent Disclosure DE 195 44 202, discloses an apparatus for controlling the tension of yarn to a set-point value. The yarn tension control apparatus is constructed such that a rake tensioner acts as both a tensioner and a yarn tension sensor. The adjustment of the adjustable yarn tensioning elements is accomplished by an electrodynamic drive mechanism made of a plunging coil and cup magnet assembly. A holder with adjustable prong-like yarn tensioning elements is connected to a rod supported vertically by bushing bearings and oriented transverse to direction of travel of the yarn. Linear bearings have the disadvantage of being vulnerable to soiling because of the unavoidable production of dust at the work stations, especially by softeners applied to the traveling yarn. Such a system also has a relatively high mass inertia because the total mass of the plunging coil and the holder must be moved over the entire adjustment distance. This construction hinders the reaction of the yarn tensioning elements to high-frequency fluctuations in the tension of the traveling yarn, thus increasing the incident of peaks of tension in the traveling yarn which impairs the function of the apparatus.

OBJECT AND SUMMARY OF THE INVENTION

Thus an object of the present invention is to provide an improved apparatus for controlling the tension of traveling yarn. This object is basically achieved by affixing displaceable yarn tensioning elements of a rake tensioner and an electrical coil to a common pivot lever that has no extraneous transmission components, with a corresponding increase in inertia, nor looseness, or play, in the transmission components. The torque generated by the electrical coil has a direct effect on the tension of the traveling yarn via the displaceable yarn tensioning elements. The control of the yarn tension can be accomplished without delay and without significant friction losses because the moment of inertia of the moving parts is slight, making possible rapid reaction to high-frequency changes in traveling yarn tension. Because of the fast reaction and the low inertia, the present invention is capable of self-monitoring and automatic control to a desired tension, and functions properly even if high-frequency peaks in the tension of the traveling yarn occurs. Hence, relatively high torques available for controlling the pivot lever, and a pivot lever with a short rotating distance, and a correspondingly long adjustment distance for the displaceable yarn tensioning elements, can be attained. Thus, the displaceable yam tensioning elements can be affixed to the lever arm at a relatively long distance from the pivot axis of the pivot lever, and the applicable lever arm can be correspondingly long and very light in weight The efficiency of the present invention in applying a requisite torque to the pivot lever is high, whereby the electrical coil can be disposed relatively close to the pivot axis.

A moment sufficient for effective control of the yarn tension can already be generated with an apparatus that is structurally quite small. The compact, structurally simple design requires little structural outlay which is highly advantageous in machines that have many work stations, such as spinning or bobbin winding machines. The apparatus also requires little space which is extremely desirable, given the limited space available at such work stations.

The rotatable pivot lever is supported by a rotary bearing, preferably a roller bearing and is thus supported with little friction. A rotary bearing, compared with a linear bearing, can be better sealed and is markedly less vulnerable to soiling. To further reduce the inertia of the controlling apparatus, a magnet bearing, hydraulic bearing, or air bearing can be used instead of the roller bearing. Additionally, the pivot lever can be made from very lightweight material, thus reducing the mass moment of inertia and the inertia associated with the controlling apparatus.

The above-described advantages lead individually and in combination to a marked improvement in an apparatus used to control the tension of a traveling yarn, particularly to the quality of the control.

Further details, features and advantages of the present invention will be disclosed in and understood from the following disclosure of one or more preferred embodiments of the present invention with reference to the accompanying drawings.

DESCRIPTION OF THE PREFERRED EMBODIMENTS

Figure 1:
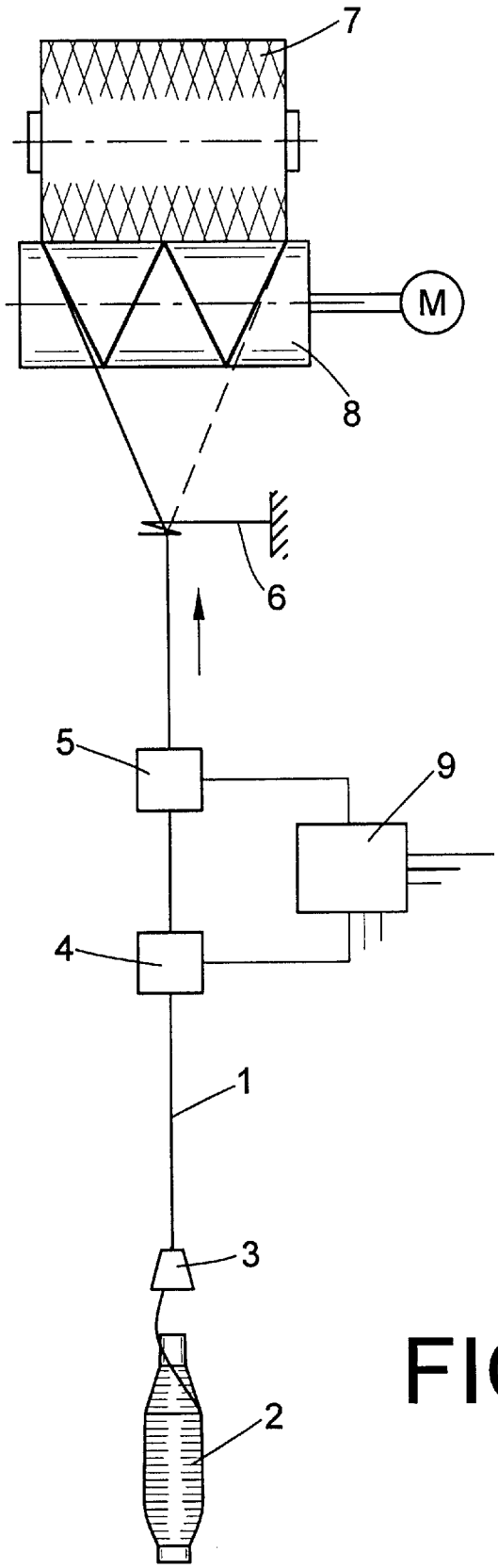
FIG. 1 is a simplified schematic view of a winding station of an automatic bobbin winder in which the present invention may preferably be embodied.
Figure 2:
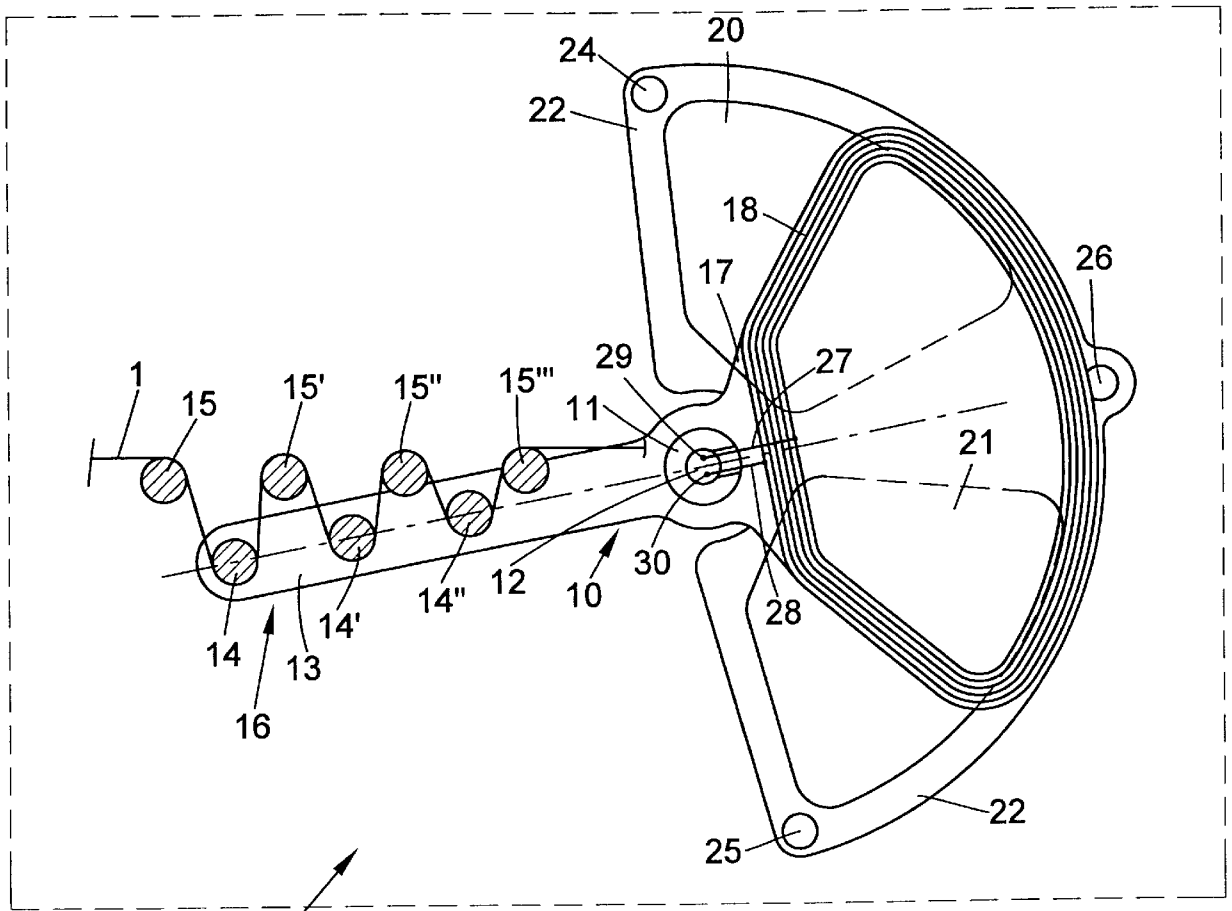
FIG. 2 is an elevational view of a preferred embodiment of the present invention.
Figure 3:
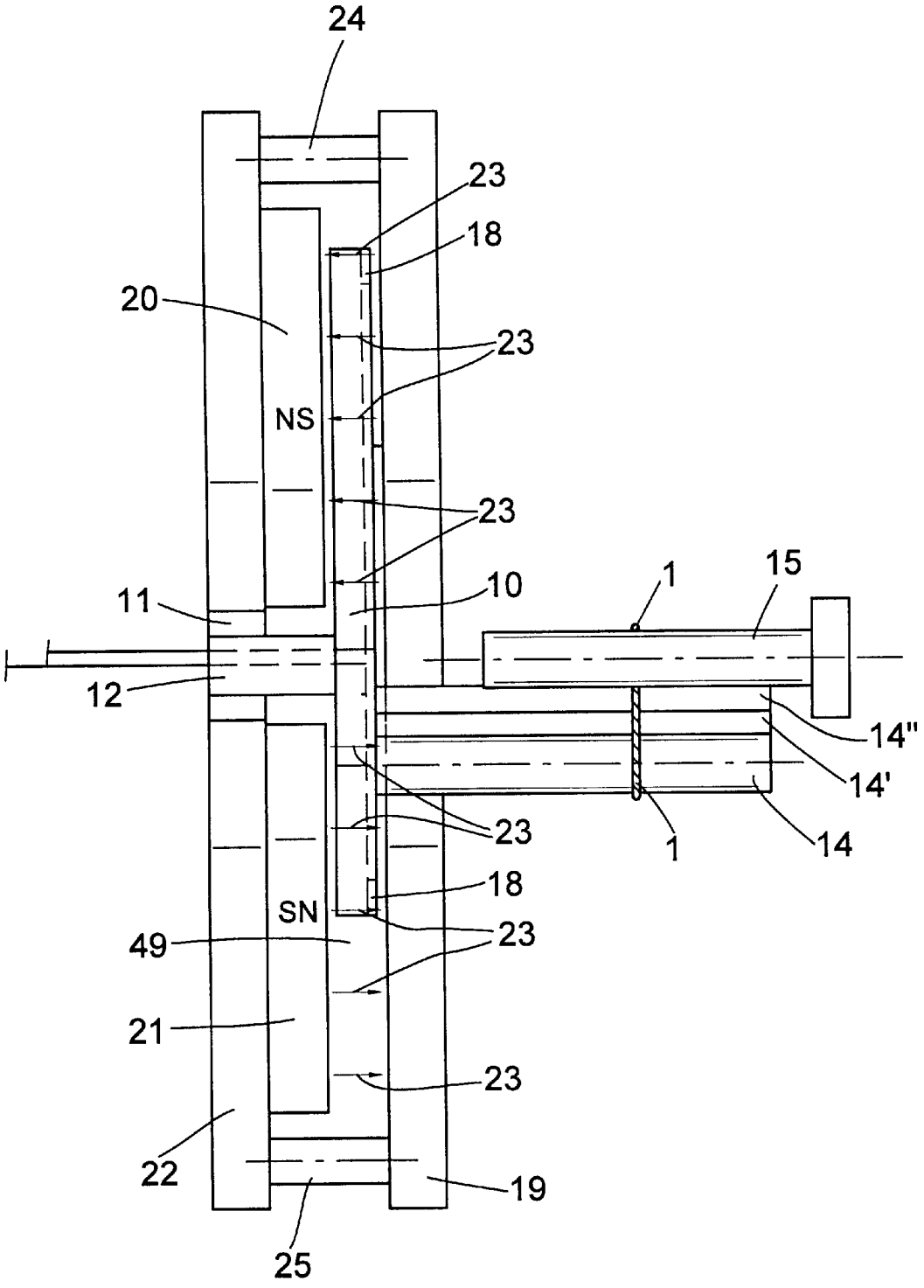
FIG. 3 is a side elevational view of the apparatus of FIG. 2.

In the winding station of a bobbin winder shown in FIG. 1, a traveling yarn 1 is drawn from a feed bobbin 2 and passes through a balloon breaker 3, a control apparatus 4 for controlling the tension of the traveling yarn 1, a yarn cleaner 5, and a stationary yarn guide element 6, before it is wound onto a rotating cheese 7. The traversing motion required to wind the cheese 7 is generated by reversing thread roller 8, which is rotatably driven by a motor M and simultaneously provides the circumferential drive for the cheese 7. The control apparatus 4 and yarn cleaner 5 are connected to a control unit 9. FIGS. 2 and 3 show a control apparatus 4, in which a pivot lever 10 can be seen that is supported by a rotary bearing, preferably a roller bearing 11, and a shaft 12. The pivot lever 10 is made from the lightest possible material, for example plastic, so that only a slight moment of inertia in pivoting motions is achieved while maintaining adequate strength in the pivot lever 10. Displaceable yarn tensioning elements 14, 14', 14" are fixedly attached to a lever arm 13 of the pivot lever 10. Stationary yarn tensioning elements 15, 15', 15", 15'" are affixed to the housing, not shown, of the control apparatus 4. The displaceable yarn tensioning elements 14, 14', 14" engage and mesh with the stationary yarn tensioning elements 15, 15', 15", 15'" to create a rake tensioner 16. The traveling yarn 1 follows a zigzag course about the displaceable yarn tensioning elements 14, 14', 14" and the stationary yarn tensioning elements 15, 15', 15", 15'". Rotation of the pivot lever 10 causes the displaceable yarn tensioning elements 14, 14', 14" and the stationary yarn tensioning elements 15, 15', 15", 15'" to change their positions relative to one another, thus changing the wrap angle of the traveling yarn 1, i.e., the angle at which the traveling yarn 1 engages and disengages the individual yarn tensioning elements. Hence the wrap angle of the traveling yarn 1 is dependent on the change in the relative positions of the displaceable yarn tensioning elements 14, 14', 14" to the stationary yarn tensioning elements 15, 15', 15", 15'". By using the rake tensioner 16, the tension imposed on the traveling yarn 1 can be controlled as a function of the wrap angle.

An electrical coil 18 is disposed on a lever arm 17 of the pivot lever 10. The electrical coil 18 and the lever arm 17 are positioned diametrically opposite the lever arm 13 across the shaft 12. The electrical coil 18 and the lever arm 17 are rotatable in an air gap 49, formed between a first yoke 19 and magnets 20, 21 affixed to a second yoke 22. The air gap 49 has a constant gap width. A magnetic field generated by the magnets 20, 21 and having magnetic field lines emanating in the direction represented by arrows 23 traverses the air gap 49. The yokes 19, 22 are connected by spokes 24, 25, 26. The magnetic field lines passing through the yokes 19, 22 and spokes 24, 25, 26 are not shown for sake of simplicity. Preferably, the magnets 20, 21 are permanent magnets and are disposed in opposite polarity upon the second yoke 22. The pole orientation of the magnets 20, 21 is represented by the letters S and N. An electrical current is supplied to the coil 18 via supply lines 27, 28. The supply lines 27, 28 extend through bores 29, 30 in the shaft 12, thus subjecting supply lines 27, 28 to only slight motions. By supplying a known electrical current to the coil 18, a torque is brought to bear on the pivot lever 10, and as a result of the forces exerted by the yarn guide 6 on the displaceable yarn tension elements 14, 14', 14", a force equilibrium ensues and a suitable pivoting position of the pivot lever 10 is triggered.

Figure 4:
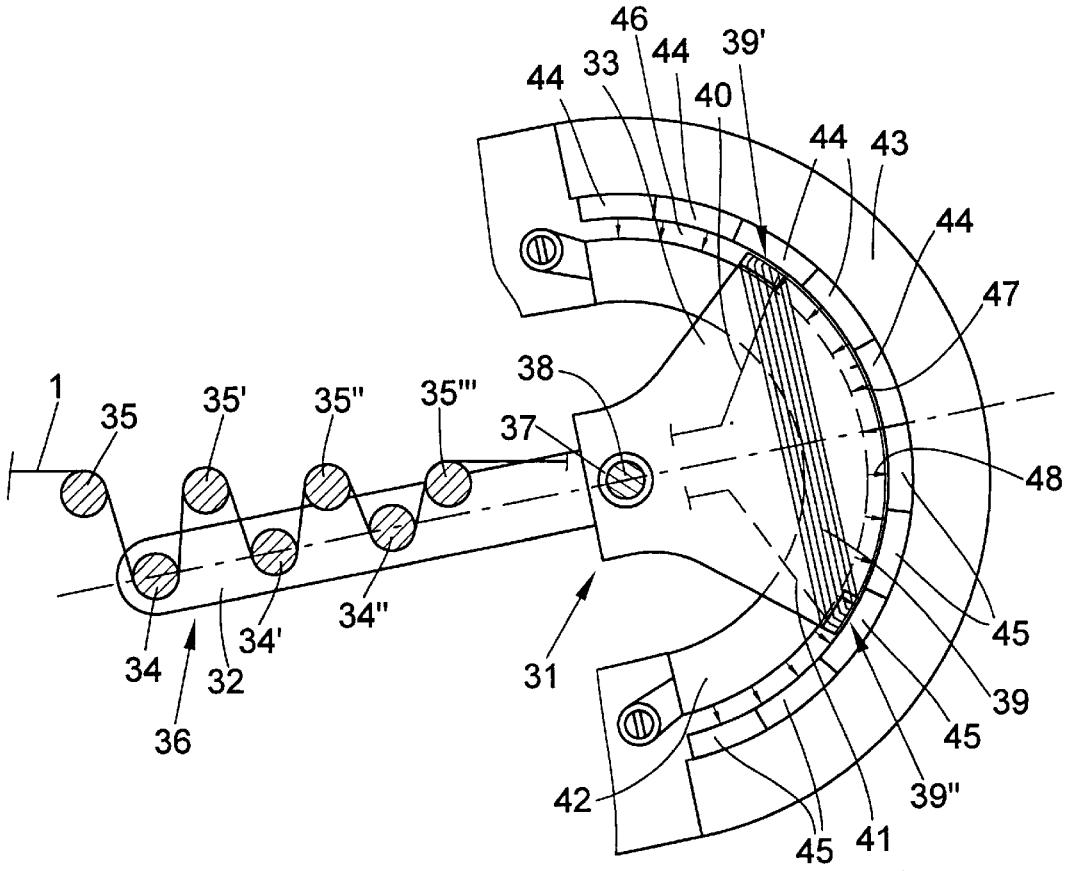
FIG. 4 is an elevational view of an alternative preferred embodiment of the present invention.

In another preferred embodiment, shown in FIG. 4, the present invention has a pivot lever 31 comprised of two lever arms 32, 33 fixedly attached to each other. Displaceable yarn tensioning elements 34, 34', 34" are disposed on the lever arm 32 and are adjustable by rotating the pivot lever 31. The displaceable yarn tensioning elements 34, 34', 34" engage and mesh with stationary yarn tensioning elements 35, 35', 35", 35'", affixed to a housing of the control apparatus, to form a rake tensioner 36.

The lever arm 33, acting as a coil holder, is supported, along with the lever arm 32, by a rotary bearing, preferably a roller bearing 37, and is pivotable about the axis of the shaft 38. A magnet bearing, air bearing or other low-friction bearings can replace the roller bearing.

An electrical coil 39 is wound on the lever arm 33 so that the center axis of the wound electrical coil 39 intersects the axis of the shaft 38. Electrical current is supplied to the electrical coil 39 by supply lines 40, 41. The supply lines 40, 41 are passed through bores in the shaft 38, thus limiting the motion to which the supply lines 40, 41 are subjected.

An inner yoke 42 is shaped as an annular segment. Opposite the outer circumference of the inner yoke 42 are segmented magnets 44, 45 disposed on an outer yoke 43, also shaped as an annular segment The inner yoke 42 and the magnets 44, 45 are separated by an air gap 46 having a constant gap width over its length. The magnets 44, 45 are positioned upon the outer yoke 43 so that a magnetic field created by the magnets 44, 45 has magnetic field lines 47 emanating from the region of the magnets 44 and toward the shaft 38, while the magnetic field lines 48 in the region of the magnets 45 are oriented toward the magnets 45. Field lines are shown only in the region of the air gap 46. An electrical current is supplied to the electrical coil 39, imposing a corresponding torque on the pivot lever 31. An advantageous feature of the disposition of the air gap 46 and the associated electrical coil 39 is that the winding strands 39', 39" of the electrical coil 39 extend into the air gap and are disposed at a relatively long distance from the pivot axis of the pivot lever 31, so that a relatively high moment can be generated on the basis of the leverage. Because of the orientation of the magnetic field lines 47, 48 and the current direction in the winding strands 39', 39" of the electrical coil 39, the current and moment are proportional over the entire relevant pivoting range of the pivot lever 31. The displaceable yarn tensioning elements 34, 34', 34", together with the stationary yarn tensioning elements 35, 35', 35", 35'", exert a braking action that controls the yarn tension.

In any of the above embodiments, electromagnets may replace the permanent magnets. Electromagnets provide a greater magnetic flux density and thus still higher output.

Other details, not shown or explained in further detail, for instance pertaining to the function of a rake tensioner, the embodiment of coils to which current is supplied, or the disposition of magnets and magnetic fields, can be learned from the references discussed above.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An apparatus for controlling tension of a traveling yarn in an automatic winding device, the apparatus having stationary yarn tensioning elements and displaceable yarn tensioning elements which are displaceable in a defined manner with respect to the stationary yam tensioning elements, the stationary and displaceable yarn tensioning elements in engagement with the traveling yarn, and including an electrical coil being supplied with electrical current by a regulating device, the tension of the traveling yarn being regulated in proportion to an electrical coil current generated by the electrical current, wherein the improvement comprises a pivot lever having disposed thereon the displaceable yarn tensioning elements and the electrical coil, the electrical coil having a pivoting range, the pivoting range being surrounded by an air gap having a constant width, and a magnet assembly proximately located to the air gap, the magnet assembly generating magnetic field lines emanating substantially perpendicular to the magnet assembly and traversing the air gap.

2. The apparatus in accordance with claim 1, wherein the pivot lever includes a first lever arm having the displaceable yarn tensioning elements disposed thereon, and a second lever arm having the electrical coil disposed thereon.

3. The apparatus in accordance with claim 2, wherein the displaceable yarn tensioning elements and the electrical coil are disposed on opposite sides of a pivot axis of the pivot lever.

4. The apparatus in accordance with claim 1, wherein the magnet assembly and the electrical coil are disposed such that the pivot lever is acted upon by a torque proportional to the electrical coil current.

5. The apparatus in accordance with claim 1, wherein the magnet assembly includes at least two magnets oriented with opposite polarity.

6. The apparatus of claim 5, wherein the magnets are permanent magnets.

* * * * *